US007123219B2

(12) United States Patent
Lee

(10) Patent No.: US 7,123,219 B2
(45) Date of Patent: Oct. 17, 2006

(54) DRIVING APPARATUS OF PLASMA DISPLAY PANEL

(75) Inventor: Joo-Yul Lee, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 10/992,200

(22) Filed: Nov. 19, 2004

(65) Prior Publication Data

US 2005/0110425 A1 May 26, 2005

(30) Foreign Application Priority Data

Nov. 24, 2003 (KR) ..... 10-2003-0083607

(51) Int. Cl.
*G09G 3/30* (2006.01)

(52) U.S. Cl. ..... 345/76; 345/211; 315/169.4

(58) Field of Classification Search ..... 315/169.1, 315/169.4; 345/63–68, 72, 76–78, 207, 211
See application file for complete search history.

(56) References Cited

U.S. PATENT DOCUMENTS

| | | | | |
|---|---|---|---|---|
| 4,866,349 | A | 9/1989 | Weber et al. | 315/169.4 |
| 5,081,400 | A | 1/1992 | Weber et al. | 315/169.4 |
| 5,550,557 | A * | 8/1996 | Kapoor et al. | 345/76 |
| 5,566,064 | A * | 10/1996 | Schoenwald et al. | 315/169.3 |
| 6,278,423 | B1 * | 8/2001 | Wald et al. | 345/76 |
| 6,995,516 | B1 * | 2/2006 | Aoki et al. | 345/76 |

* cited by examiner

*Primary Examiner*—Wilson Lee
(74) *Attorney, Agent, or Firm*—H.C. Park & Associates, PLC

(57) ABSTRACT

A driving apparatus of a plasma display panel with a reduced number of low pass filters due to coupling clamping diodes to charge and discharge switches of a power recovery circuit. The driving circuit overcomes electromagnetic interference and noise problems and effectively clamps voltages.

12 Claims, 8 Drawing Sheets

DRIVING APPARATUS OF PLASMA DISPLAY PANEL

CROSS REFERENCE TO RELATED APPLICATION

This application claims priority to and the benefit of Korean Patent Application No. 10-2003-0083607, filed on Nov. 24, 2003, which is hereby incorporated by reference for all purposes as if fully set forth herein.

BACKGROUND OF THE INVENTION

1. Field of the Invention

The present invention relates to a driving apparatus of a plasma display panel (PDP).

2. Discussion of the Related Art

Flat panel displays, such as liquid crystal displays (LCDs), field emission displays (FEDs) and PDPs, are being actively developed. PDPs have high luminance, high luminous efficiency and a wide viewing angle. Accordingly, they are being highlighted as the primary substitute for conventional cathode ray tubes (CRTs) for large-screen displays of more than 40 inches.

PDPs use plasma generated by gas discharge to display characters or images, and depending on their size, they may have several thousands to millions of pixels. PDPs may be classified as direct current (DC) type and alternating current (AC) type according to voltage driving waveforms and discharge cell structures.

The AC PDP's electrodes are covered with a dielectric layer, which protects the electrodes during discharge. Therefore, the AC PDP has a longer lifespan than the DC PDP.

A typical AC PDP includes scan electrodes and sustain electrodes formed in parallel on one main surface of the PDP, and address electrodes, orthogonally arranged to the scan and sustain electrodes, are formed on the PDP's other main surface.

In general, a typical AC PDP driving method uses a reset period, an address period, and a sustain period.

During the reset period, cells are reset so as to readily perform the subsequent address operation. During the address period, cells that are to be turned on are selected, and an address discharge accumulates wall charges in the turned-on cells (i.e., addressed cells). During the sustain period, images are displayed by applying a sustain discharge voltage pulse to the addressed cells.

As used herein, "wall charges" refers to charges that accumulate on the electrodes and are formed on the wall (e.g., dielectric layer) of the discharge cells. The wall charges may not actually contact the electrodes because they are covered by a dielectric layer. However, for ease of description, the wall charges may be described herein as being "formed on", "stored on" or "accumulated on" the electrodes.

U.S. Pat. Nos. 4,866,349 and 5,081,400 disclose a sustain discharge circuit (or a power recovery circuit) that may recover inactive power for charging and discharging a panel capacitor. The power recovery circuit may charge and discharge the panel capacitor using an inductor and an LC resonance.

FIG. 1 shows a conventional power recovery circuit.

As shown in FIG. 1, the power recovery circuit includes a sustain discharge path having sustain discharge switches $Y_s$, $Y_g$, $X_s$ and $X_g$, and charge and discharge paths for charging electric charges between the panel capacitor $C_p$ and the power recovery capacitors $C_{yr}$ and $C_{xr}$. A Y electrode may be charged through a path of a switch $Y_r$, a diode $YD_r$ and an inductor $L_y$ and may be discharged through a path of the inductor $L_y$, a diode $YD_f$ and a switch $Y_f$. Similarly, an X electrode may be charged through a path of a switch $X_r$, a diode $XD_r$ and an inductor $L_x$ and may be discharged through a path of the inductor $L_x$, a diode $XD_f$ and a switch $X_f$.

However, the inductor and parasite capacitors of the switches may resonate, thereby generating a distorted waveform such as an overshoot and an undershoot. Accordingly, in order to suppress the distorted waveform and reduce a withstand voltage of the switches, the power recovery circuit further includes clamping diodes YDCH, XDCH, YDCL and XDCL for preventing a voltage at the front stage of the inductors $L_y$ and $L_x$ from rising above a fixed voltage $V_s$ or falling below 0 V.

Additionally, in order to overcome electromagnetic interference (EMI) problems and noise due to the resonance between inductors and parasite capacitors, low pass filters (LPF), such as EMI beads, for suppressing high frequency components may be inserted between diodes.

However, these LPFs may be provided on the same path as the clamping diodes, which may lead to poor functionality of the clamping diodes.

SUMMARY OF THE INVENTION

The present invention provides a driving apparatus of a plasma display panel that may overcome an EMI problem without causing erroneous circuit operations.

Additional features of the invention will be set forth in the description which follows, and in part will be apparent from the description, or may be learned by practice of the invention.

The present invention discloses a driving apparatus of a plasma display panel for applying a voltage to an electrode of a panel capacitor, comprising an inductor having a first end and a second end, where the first end is coupled to the electrode of the panel capacitor. A first switch causes current to flow into the panel capacitor through the inductor is coupled between the second end of the inductor and a first power source to supply a first voltage. A second switch causes current to flow out of the panel capacitor through the inductor, and it is coupled between the second end of the inductor and the first power source. A third switch causes a second voltage to be applied to the electrode of the panel capacitor after the panel capacitor is charged, and the third switch is coupled between the electrode of the panel capacitor and a second power source to supply the second voltage. A fourth switch causes a third voltage to be applied to the electrode of the panel capacitor after the panel capacitor is discharged, and the fourth switch is coupled between the electrode of the panel capacitor and a third power source to supply the third voltage. A first diode has an anode coupled to a first end of the second switch and a cathode coupled to the second power source, and a first filter for removing high frequency components is coupled between the first end of the second switch and the second end of the inductor.

The present invention also discloses a driving apparatus of a plasma display panel for applying a voltage to an electrode of a panel capacitor comprising first and second inductors each having a first end and a second end, and each of the first ends coupled to the electrode of the panel capacitor. A first switch couples the second end of the first inductor and a first power source to supply a first voltage. A second switch couples the second end of the second inductor and the first power source. A third switch couples the electrode of the panel capacitor and a second power source to supply a second voltage. A fourth switch couples the electrode of the panel capacitor and a third power source to supply a third voltage. A first diode provides that a voltage over the second voltage is not applied to the first electrode, and the first diode's anode is coupled to a first end of the second switch and its cathode is coupled to the second power source. A first filter removes high frequency components, and is coupled between the first end of the second switch and the second end of the second inductor.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION

Figure 1:
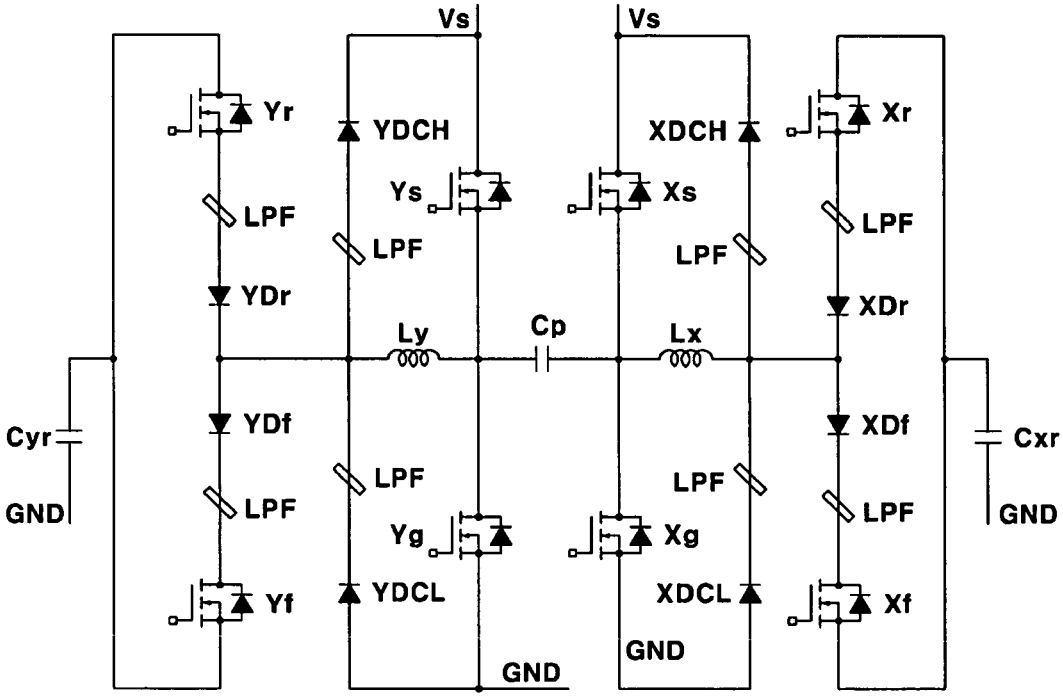
FIG.1 (Prior Art)
FIG. 1 shows a conventional power recovery circuit.

The following detailed description shows and describes certain exemplary embodiments of the present invention. As those skilled in the art would recognize, the described exemplary embodiments may be modified in various ways, all without departing from the spirit or scope of the present invention. Accordingly, the drawings and description are to be regarded as illustrative in nature, rather than restrictive. In the drawings, illustrations of elements having no relation with the present invention are omitted in order to prevent the subject matter of the present invention from being unclear. Same or similar elements may be denoted by the same reference numerals in different drawings.

Now, a driving apparatus of a PDP according to an exemplary embodiment of the present invention will be described with reference to the drawings.

Figure 2:
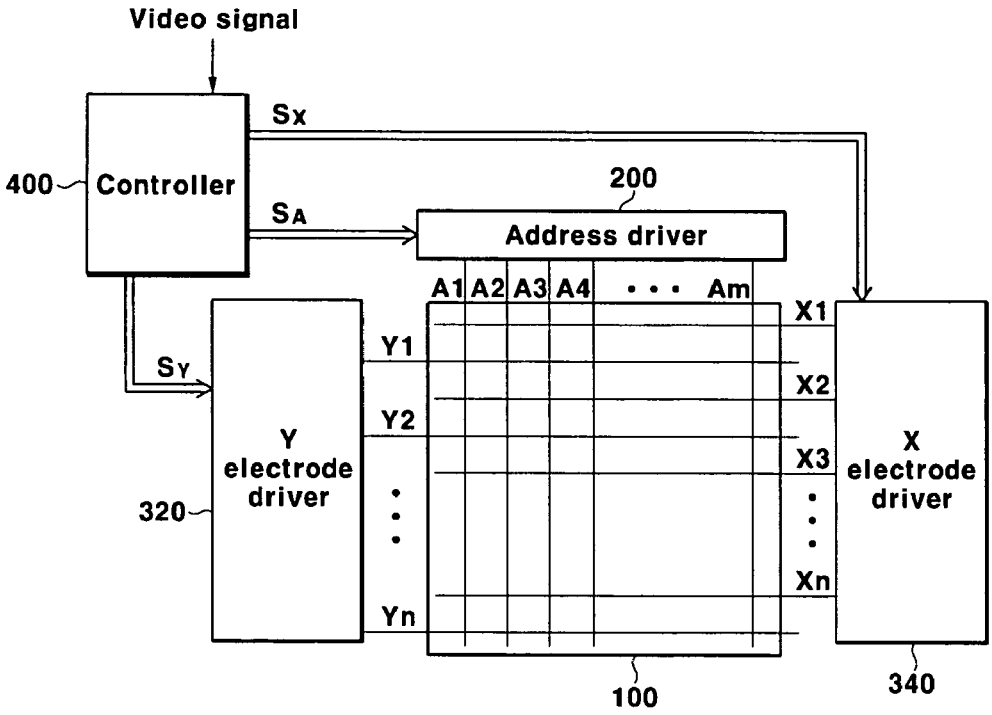
FIG. 2 shows a PDP driving according to an exemplary embodiment of the present invention.

FIG. 2 shows a general structure of the PDP according to an exemplary embodiment of the present invention.

As shown in FIG. 2, the PDP comprises a plasma panel 100, an address driver 200, a Y electrode driver 320, an X electrode driver 340, and a controller 400.

The plasma panel 100 includes a plurality of address electrodes $A_1$ to $A_m$ arranged in the column direction, and a plurality of Y, or scan, electrodes $Y_1$ to $Y_n$ and a plurality of X, or sustain, electrodes $X_1$ to $X_n$ alternately arranged in pairs in the row direction.

The controller 400 receives a video signal and generates an address driving control signal $S_A$, a Y electrode driving signal $S_Y$ and an X electrode driving signal $S_X$, and applies these signals to the address driver 200, the Y electrode driver 320 and the X electrode driver 340, respectively.

The address driver 200 receives the address driving control signal $S_A$ from the controller 400 and applies display data signals to the address electrodes $A_1$ to $A_m$ to select desired discharge cells.

The Y electrode driver 320 and the X electrode driver 340 receive the Y electrode driving signal $S_Y$ and the X electrode driving signal $S_X$, respectively, from the controller 400 and process the signals $S_Y$ and $S_X$ to drive the Y and X electrodes, respectively.

Hereinafter, the structure and operation of a sustain driving circuit will be described in detail with reference to FIG. 3, FIG. 4, FIGS. 5A–5D, and FIG. 6.

Figure 3:
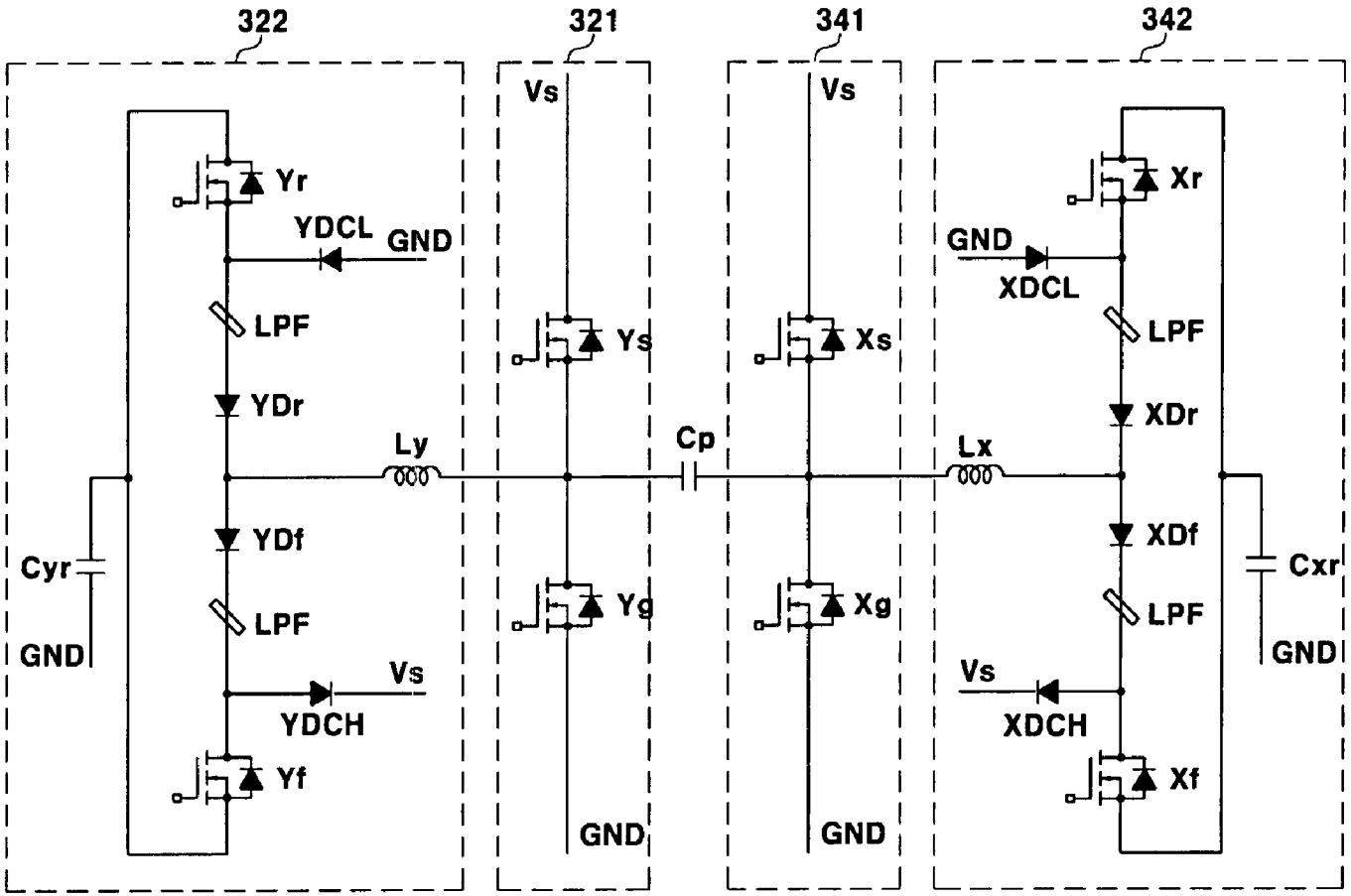
FIG. 3 shows a sustain driving circuit according to a first exemplary embodiment of the present invention.

FIG. 3 shows a sustain driving circuit according to a first exemplary embodiment of the present invention.

As shown in FIG. 3, the sustain driving circuit includes a Y electrode sustainer 321, a Y electrode power recoverer 322, an X electrode sustainer 341, and an X electrode power recoverer 342. A panel capacitor $C_p$ is coupled to the Y electrode sustainer 321 and the X electrode sustainer 341.

The Y electrode sustainer 321 and the X electrode sustainer 341 include switches $Y_s$, $Y_g$ and $X_s$, $X_g$, respectively, coupled between a power source stage $V_s$, which supplies a voltage $V_s$, and a ground stage GND.

The Y electrode power recoverer 322 includes a power recovery capacitor $C_{yr}$, an inductor $L_y$, a switch $Y_r$ and a diode $YD_r$, which form a charge path, a switch $Y_f$ and a diode $YD_f$, which form a discharge path, and clamping diodes YDCH and YDCL.

The clamping diode YDCH may prevent a drain voltage of the switch $Y_f$ from exceeding the voltage $V_s$ due to an overshoot, and it may be coupled between the drain of the switch $Y_f$ and the power source stage $V_s$. The clamping diode YDCL may prevent a voltage of the switch $Y_r$ from falling below 0 V due to an undershoot, and it may be coupled between the source of the switch $Y_r$ and the ground stage GND. Additionally, LPFs for removing EMI and noise may be inserted between the switch $Y_r$ and the diode $YD_r$ and between the switch $Y_f$ and the diode $YD_f$.

The X electrode power recoverer 342 includes a power recovery capacitor $C_{xr}$, an inductor $L_x$, a switch $X_r$ and a diode $XD_r$, which form a charge path, a switch $X_f$ and a diode $XD_f$, which form a discharge path, and clamping diodes XDCH and XDCL.

The clamping diode XDCH may prevent a voltage at the front stage of the inductor $L_x$ from exceeding the voltage $V_s$, and it may be coupled between the drain of the switch $X_f$ and the power source stage $V_s$. The clamping diode XDCL may prevent a voltage at the front stage of the inductor $L_x$ from falling below 0 V, and it may be coupled between the source of the switch $X_r$ and the ground stage GND. Additionally, LPFs for removing EMI and noise may be inserted between the switch $X_r$ and the diode $XD_r$ and between the switch $X_f$ and the diode $XD_f$.

In FIG. 3, the switches $Y_r$, $Y_f$, $Y_s$, $Y_g$, $X_s$, $X_g$, $X_r$ and $X_f$ may be formed as an n-type MOSFET, each of which may include a body diode.

Figure 4:
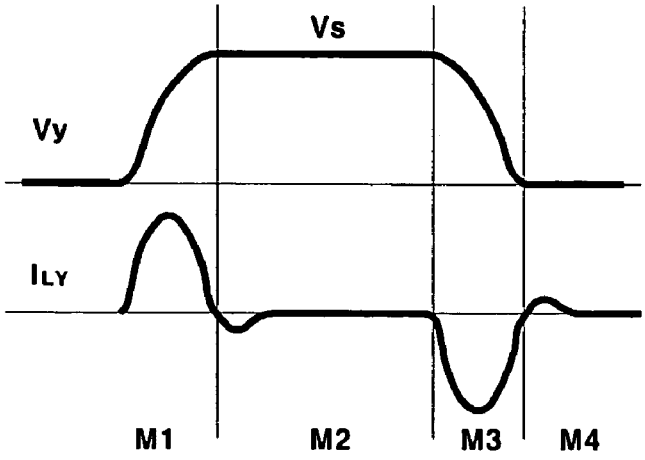
FIG. 4 is a waveform diagram showing a voltage of a Y electrode and a current in an inductor according to the first exemplary embodiment of the present invention.

The following describes how the sustain driving circuit of FIG. 3 operates over time, with reference to FIG. 4 and FIGS. 5A to 5D. As shown by FIG. 4, the sustain driving circuit may repeat first through fourth modes $M_1$ to $M_4$, which may be changed by operation of the switches. The term resonance, as used herein, refers to a change of voltage and current caused by a combination of the inductors $L_y$ and $L_x$ and the panel capacitor $C_p$ when the switches $Y_r$, $Y_f$, $X_r$ and $X_f$ are on.

Additionally, the panel capacitor Cp is an equivalent representation of a capacitance component between an X electrode and a Y electrode. The X electrode of the panel capacitor Cp is shown to be coupled to the ground only for the sake of convenience. As shown in FIG. 2, it is actually coupled to the X electrode driver 340. The following describes operation of the Y electrode driver 320, but not the X electrode driver 340, because the X electrode driver 340 operates similarly to the Y electrode driver 320.

FIG. 4 is a waveform diagram showing a voltage of a Y electrode and a current $I_{LY}$ in an inductor $L_y$ according to the first embodiment of the present invention, and FIGS. 5A to 5D show current paths during first through fourth modes $M_1$, $M_2$, $M_3$ and $M_4$ of operation in a Y electrode sustain driving circuit.

It is assumed that the power recovery capacitor $C_{yr}$ is charged to a voltage V ($V=V_s/2$) before the first mode $M_1$ starts.

Figure 5A:
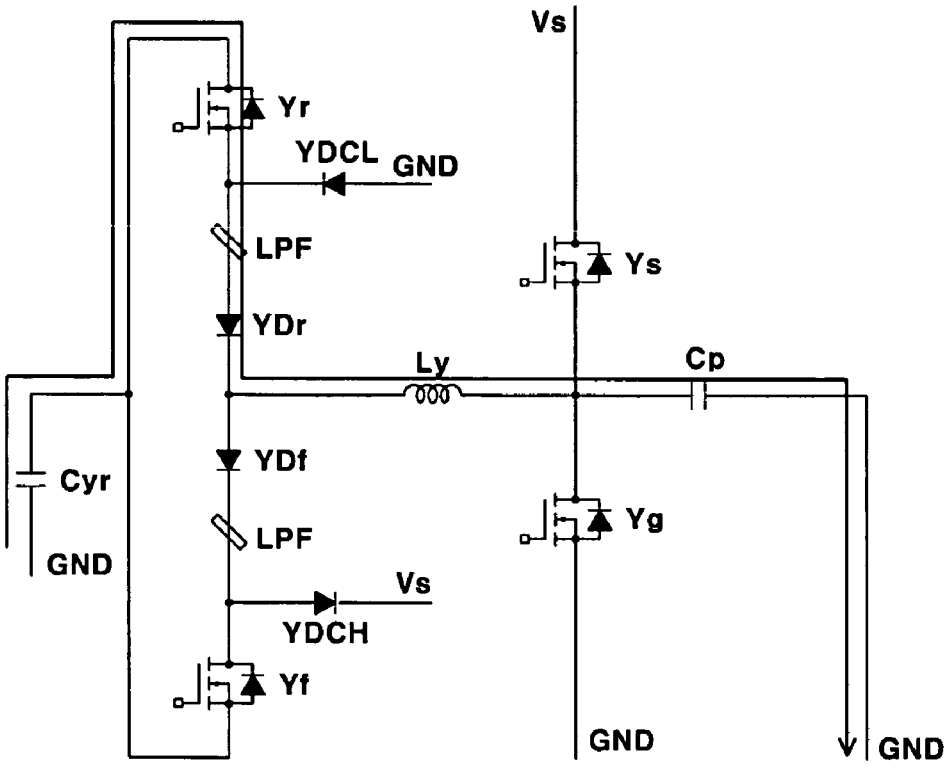
FIG. 5A, FIG. 5B, FIG. 5C and FIG. 5D show current paths in a Y electrode sustain driving circuit during different operation modes according to the first exemplary embodiment of the present invention.

FIG. 5A shows a first mode $M_1$ of operation of the Y electrode sustain driving circuit according to the first exemplary embodiment of the present invention.

The switch Yr is turned on in the first mode $M_1$. Then, as shown in FIG. 5A, a current path including the power recovery capacitor $C_{yr}$, the switch $Y_r$, the inductor $L_y$ and the panel capacitor $C_p$ is formed, thereby inducing resonance between the inductor $L_y$ and the panel capacitor $C_p$. According to the resonance, a voltage $V_y$ of the Y electrode of the panel capacitor $C_p$ gradually increases from 0 V to the voltage $V_s$, thereby charging the panel capacitor $C_p$, as shown in FIG. 4.

Additionally, as shown in FIG. 4, the current $I_{Ly}$ may increase at a gradient of V/L and then decrease at a gradient of $-(V_s-V)/L$.

LPFs provided in the current path formed in the first mode $M_1$ may remove EMI and noise.

Figure 5B:
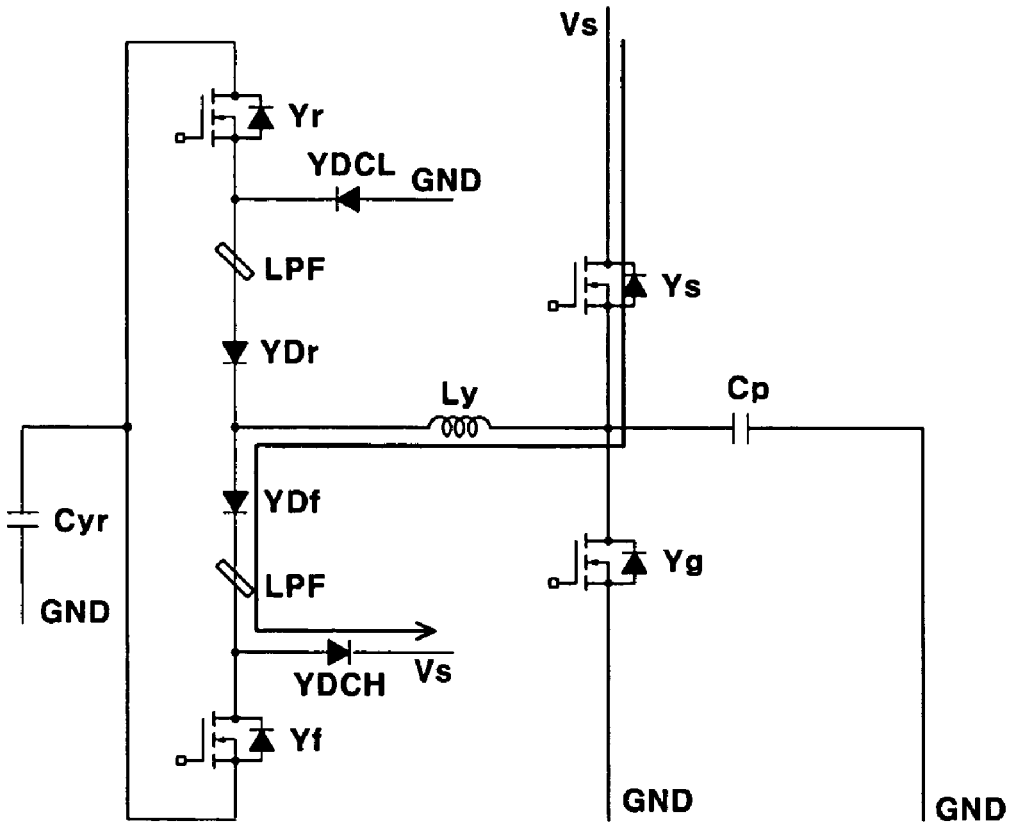

FIG. 5B shows a second mode $M_2$ of operation of the Y electrode sustain driving circuit.

When the current $I_{LY}$ decreases to 0 A, the switch $Y_r$ is turned off in of the second mode $M_2$. The switch $Y_s$ is turned on in the second mode $M_2$, and the Y electrode voltage $V_y$ of the panel capacitor $C_p$ maintains the voltage $V_s$.

Additionally, since current remaining in the inductor $L_y$ after the first mode $M_1$ may be recovered through a path of the switch $Y_s$, the inductor $L_y$, the clamping diode YDCH, and the power source $V_s$, as shown in FIG. 5B, the drain voltage of the switch $Y_f$ may not exceed the voltage $V_s$ due to resonance between the inductor $L_y$, the diodes, and parasite capacitors of the switches.

Also, since the source of the switch $Y_f$ is coupled to the power recovery capacitor $C_{yr}$ and its drain is coupled to the power source $V_s$ by the clamping diode YDCH, withstand voltages of the switch $Y_f$ and the clamping diode YDCH may decrease to $V_s/2$. In this case, LPFs provided in the current path remove EMI and noise.

Figure 5C:
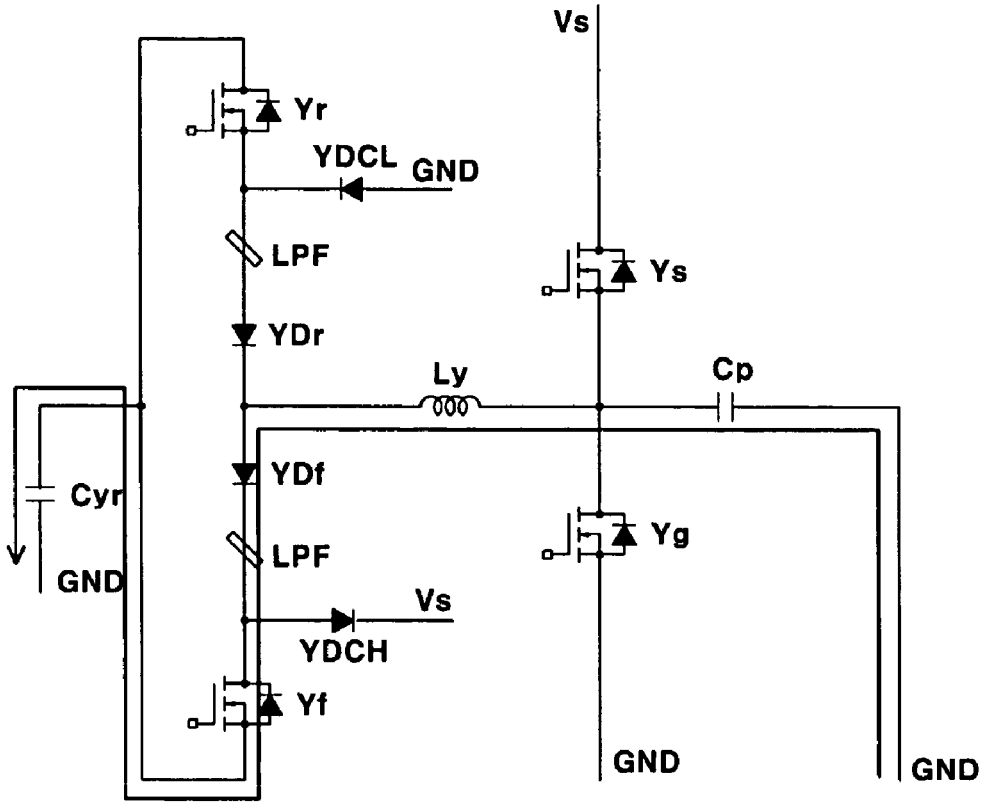

FIG. 5C shows a third mode $M_3$ of operation of the Y electrode sustain driving circuit.

The switch Yf is turned on in the third mode M3. Then, as shown in FIG. 5C, a current path including the panel capacitor Cp, the inductor Ly, the switch Yf, and the capacitor Cyr is formed, thereby inducing resonance between the inductor Ly and the panel capacitor Cp. According to the resonance, the Y electrode voltage Vy of the panel capacitor Cp gradually decreases to 0 V, thereby discharging the panel capacitor Cp.

Additionally, as shown in FIG. 4, the current $I_{Ly}$ may decrease at a gradient of $-(V_s-V)/L$ and then increase at a gradient of V/L.

LPFs provided in the current path may remove EMI and noise.

Figure 5D:
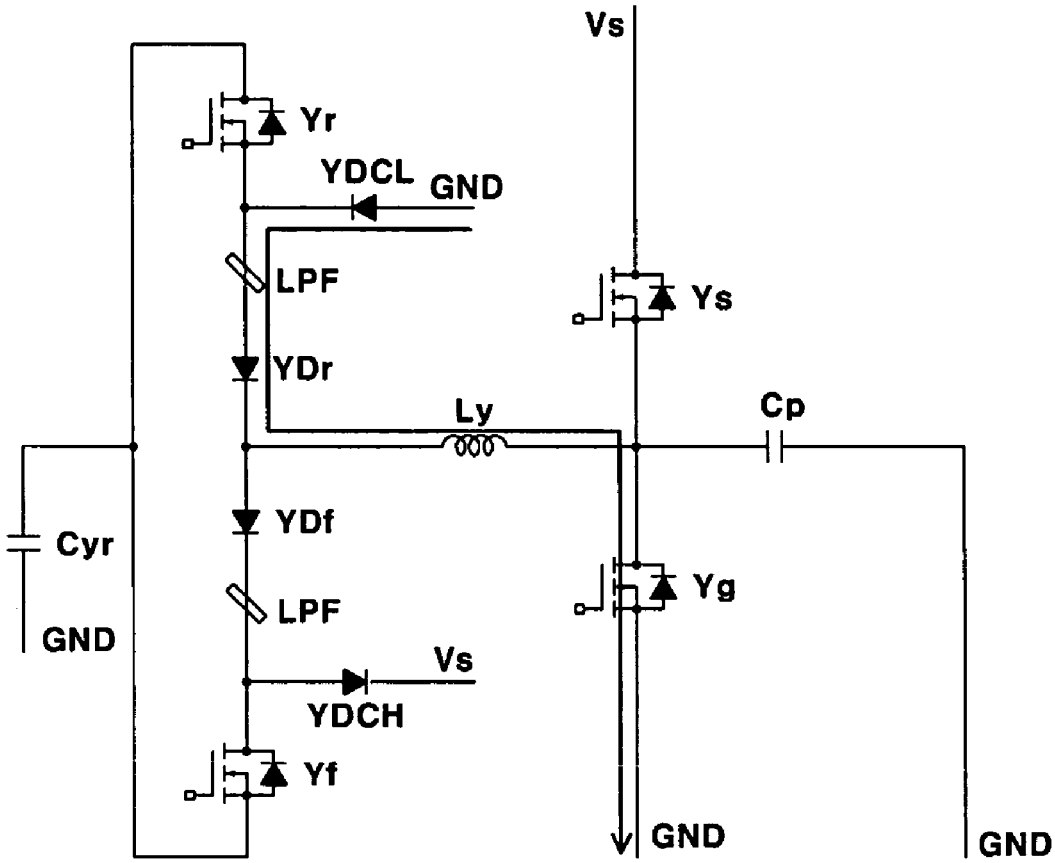

FIG. 5D shows a fourth mode $M_4$ of operation of the Y electrode sustain driving circuit.

The switch $Y_g$ is turned on in the fourth mode $M_4$. Accordingly, the Y electrode voltage $V_y$ of the panel capacitor $C_p$ maintains 0 V.

Since current remaining in the inductor $L_y$ after the third mode $M_3$ may be recovered through a path of the ground GND, the clamping diode YDCL, the inductor $L_y$, and the switch $Y_g$, as shown in FIG. 5D, the source voltage of the switch $Y_r$ may not fall below 0 V due to resonance between the inductor $L_y$, the diodes, and parasite capacitors of the switches.

Also, since the drain of the switch Yr is coupled to the power recovery capacitor Cyr and its source is coupled to the ground GND by the clamping diode YDCL, withstand voltages of the switch Yr and the clamping diode YDCL may decrease to Vs/2. In this case, LPFs provided in the current path may remove EMI and noise.

After the fourth mode $M_4$, operation of the first through fourth modes $M_1$ to $M_4$ may repeat in the X electrode driver.

The sustain discharge driving circuit according to the first exemplary embodiment of the present invention has a reduced number of LPFs while overcoming the EMI problem and lowering withstand voltages of switches and diodes by coupling the clamping diodes between the switches and the power source stages of the power recoverers.

Figure 6:
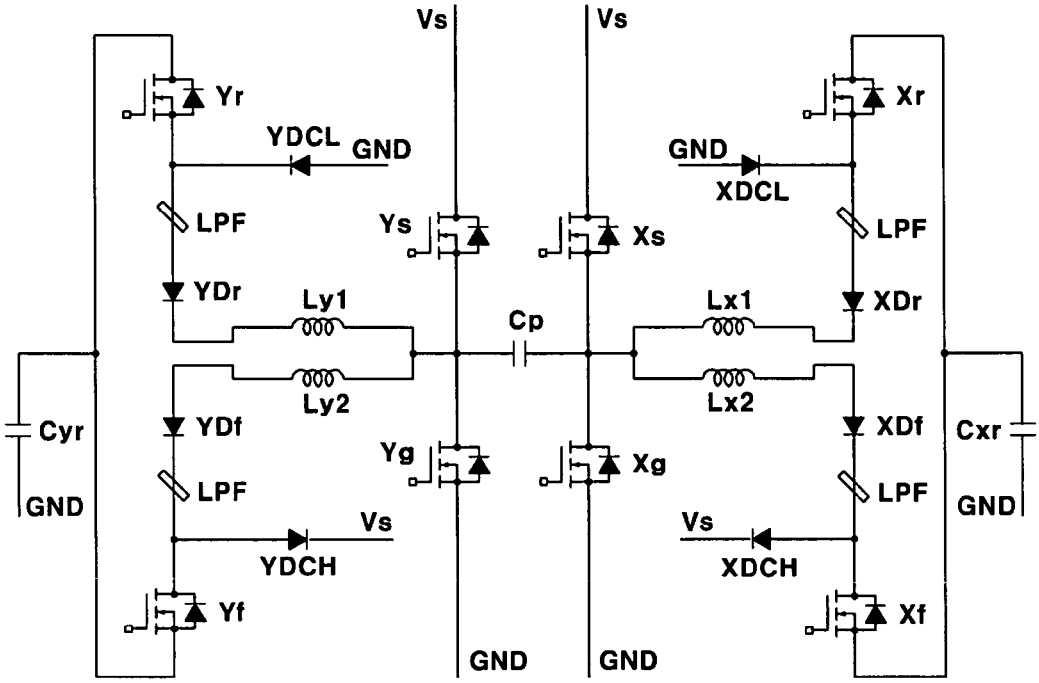
FIG. 6 shows a sustain driving circuit according to a second exemplary embodiment of the present invention.

Although the inductors $L_x$ and $L_y$ are coupled to the respective X and Y electrodes and the charge and discharge paths are alternately established through a single inductor, as shown in FIG. 6, the charge path may be separate from the discharge path by using two inductors.

FIG. 6 shows a sustain driving circuit according to a second exemplary embodiment of the present invention.

As shown in FIG. 6, the sustain driving circuit according to the second exemplary embodiment of the present invention includes inductors $L_{y1}$ and $L_{x1}$ provided in the charge path and inductors $L_{y2}$ and $L_{x2}$ provided in the discharge path. Except for this change, the structure and operation of the circuit of the second exemplary embodiment is the same as those of the first exemplary embodiment, and therefore, the explanation thereof will be omitted.

In the sustain discharge circuit according to the second exemplary embodiment of the present invention, power consumption may decrease because current flows in only one direction through the inductors $L_{y1}$, $L_{x1}$, $L_{y2}$ and $L_{x2}$.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

For example, although a voltage$+V_s$ and a voltage GND are alternately applied to the panel capacitor in a sustain period in the first and second exemplary embodiments of the present invention, a voltage$+V_s$ and a voltage$-V_s$ may alternatively be applied to the panel capacitor as a sustain discharge voltage.

As described above, coupling clamping diodes to charge and discharge switches of the power recovery circuit and reducing the number of LPFs may overcome the EMI and noise problems and clamp voltages effectively.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A driving apparatus of a plasma display panel for applying a voltage to an electrode of a panel capacitor, comprising:

an inductor having a first end and a second end, the first end coupled to the electrode of the panel capacitor;

a first switch for causing current to flow into the panel capacitor through the inductor, the first switch coupled between the second end of the inductor and a first power source to supply a first voltage;

a second switch for causing current to flow out of the panel capacitor through the inductor, the second switch coupled between the second end of the inductor and the first power source;

a third switch for causing a second voltage to be applied to the electrode of the panel capacitor after the panel capacitor is charged, the third switch coupled between the electrode of the panel capacitor and a second power source to supply the second voltage;

a fourth switch for causing a third voltage to be applied to the electrode of the panel capacitor after the panel capacitor is discharged, the fourth switch coupled between the electrode of the panel capacitor and a third power source to supply the third voltage;

a first diode for clamping such that a voltage over the second voltage is not applied to the electrode of the panel capacitor, the first diode having an anode coupled to a first end of the second switch and a cathode coupled to the second power source; and a first filter for removing high frequency components, the first filter coupled between the first end of the second switch and the second end of the inductor.

2. The driving apparatus of claim 1, further comprising:

a second diode for clamping such that a voltage below the third voltage is not applied to the electrode of the panel capacitor, the second diode having a cathode coupled to a first end of the first switch and an anode coupled to the third power source; and a second filter for removing high frequency components, the second filter coupled between the first end of the first switch and the second end of the inductor.

3. The driving apparatus of claim 1, further comprising:

a third diode for determining a direction of current flow to cause the panel capacitor to be charged, the third diode arranged in a path including the first power source, the first switch and the inductor; and a fourth diode for determining a direction of current flow to cause the panel capacitor to be discharged, the fourth diode arranged in a path including the first power source, the second switch and the inductor.

4. The driving apparatus of claim 2, further comprising:

a third diode for determining a direction of current flow to cause the panel capacitor to be charged, the third diode arranged in a path including the first power source, the first switch and the inductor; and a fourth diode for determining a direction of current flow to cause the panel capacitor to be discharged, the fourth diode arranged in a path including the first power source, the second switch and the inductor.

5. The driving apparatus of claim 1, wherein the electrode of the panel capacitor is a scan electrode or a sustain electrode.

6. The driving apparatus of claim 1, wherein the first power source is a capacitor charged by a voltage of half a difference between the second voltage and the third voltage.

7. A driving apparatus of a plasma display panel for applying a voltage to an electrode of a panel capacitor, comprising:

a first inductor and a second inductor each having a first end and a second end, each of the first ends coupled to the electrode of the panel capacitor;

a first switch coupled between the second end of the first inductor and a first power source to supply a first voltage;

a second switch coupled between the second end of the second inductor and the first power source;

a third switch coupled between the electrode of the panel capacitor and a second power source to supply a second voltage;

a fourth switch coupled between the electrode of the panel capacitor and a third power source to supply a third voltage;

a first diode for clamping such that a voltage over the second voltage is not applied to the electrode of the panel capacitor, the first diode having an anode coupled to a first end of the second switch and a cathode coupled to the second power source; and a first filter for removing high frequency components, the first filter coupled between the first end of the second switch and the second end of the second inductor.

8. The driving apparatus of claim 7, wherein the first switch is turned on to cause the panel capacitor to be charged by resonance between the first inductor and the panel capacitor, and the third switch is turned on to cause the second voltage to be applied to the electrode of the panel capacitor after the panel capacitor is charged, and wherein the second switch is turned on to cause the panel capacitor to be discharged by resonance between the second inductor and the panel capacitor, and the fourth switch is turned on to cause the third voltage to be applied to the electrode of the panel capacitor after the panel capacitor is discharged.

9. The driving apparatus of claim 7, further comprising:

a second diode for clamping such that a voltage below the third voltage is not applied to the electrode of the panel capacitor, the second diode having a cathode coupled to a first end of the first switch and an anode coupled to the third power source; and a second filter for removing high frequency components, the second filter coupled between the first end of the first switch and the second end of the first inductor.

10. The driving apparatus of claim 7, wherein the first inductor and the second inductor have the same inductance.

11. The driving apparatus of claim 7, wherein the electrode of the panel capacitor is a scan electrode or a sustain electrode.

12. The driving apparatus of claim 7, wherein the first power source is a capacitor charged by a voltage of half a difference between the second voltage and the third voltage.

* * * * *